US005854436A

United States Patent [19]

Wernick

[11] Patent Number: 5,854,436

[45] **Date of Patent: *Dec. 29, 1998**

[54] PERCUSSION PADS

[76] Inventor: William Melville Wernick, 19 Tichborne Street, Leicester, LE2 ONQ, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 614,958

[22] Filed: Mar. 11, 1996

[30] Foreign Application Priority Data

Mar. 11, 1995 [GB] United Kingdom ..... 9504964

[51] Int. Cl.[6] ..... G10D 13/02

[52] U.S. Cl. ..... 84/411 P; 84/743; 84/734

[58] Field of Search ..... 84/411 P, 411 R, 84/414, 418, 419, 420, 411 A, DIG. 12, 743, 734

[56] References Cited

U.S. PATENT DOCUMENTS 4,581,973 4/1986 Hoshiro ..... 84/411 P
4,669,349 6/1987 Hyakutake ..... 84/DIG. 12

*Primary Examiner*—Cassandra C. Spyrou
*Attorney, Agent, or Firm*—Kilgannon & Steidl

[57] ABSTRACT

A percussion pad includes an upper surface 28 that may be struck to activate the pad and a lower surface 18 on which is mounted a sensor 20 for detecting when the upper surface 28 is struck. An enclosed cavity 24 is located above the region of the lower surface 18 on which the sensor 20 is mounted. The cavity 24 prevents the shock wave of an impact above the sensor 20 from being transmitted directly to the sensor 20. Because shock waves will not propagate significantly around the cavity or along oblique paths from other parts of the surface 28, the sensitivity of the pad is uniform over the surface 28. An outer layer 26 of the pad is preferably formed of rubber-like material to reduce the acoustic sound of an impact and give a drum-like feel.

8 Claims, 4 Drawing Sheets

PERCUSSION PADS

BACKGROUND OF THE INVENTION

1. Field of the Invention

The invention relates to percussion pads, which are used typically as part of a drum kit. When the surface of a percussion pad is struck with a drumstick, a sensor detects the impact and emits electronic signals that are processed, amplified and fed to speakers to produce sounds. The electronic processing may be changed to vary the sounds produced. It is not the purpose of a percussion pad to produce acoustic sound directly from the impact of a drumstick.

2. Description of the Prior Art

Known electronic percussion pads have a variety of shapes, most commonly circular, but all are constructed in a similar way. A generally flat, solid block, typically of plywood, is resiliently supported on a fixed base. The mounting of the block is such that, when its upper surface is struck with a drumstick, the block can move relative to the base. Oscillations of the block are detected by a sensor mounted on its lower surface and the sensor generates electronic signals, which are fed to external circuitry for the production of sounds. The electronic signals generated by striking the pad may also be used to control other systems, such as lighting.

The percussion pads to which the present invention relates should not be confused with electronic drums of the type having a drum skin stretched over an air space. Such drums operate in a different manner, whereby impacts on the drum skin are transmitted through an air space and are detected as air vibrations by a sensor within the air space. The frequency of vibration of a drum skin is typically much lower than that of a percussion pad in accordance with the present invention.

In this specification the term "upper" is used to describe the surface of the block that is struck to activate the pad and "lower" describes the opposite surface on which the sensor is mounted. "Above" and "below" are used accordingly and "lateral" defines any direction generally perpendicular to "up" and "down". Of course, it is not necessary for the percussion pad to be orientated such that its upper surface is horizontal in use.

The piezoelectric sensors commonly used to detect the impact of a drumstick are small in size compared to the surface of the percussion pad. This gives rise to a problem in known percussion pads, whereby a pad is not uniformly sensitive over its surface. When an impact on the upper surface of the solid block occurs directly above the location of the sensor on its lower surface, the resulting shock wave is transmitted rapidly through the thickness of the block to the sensor and causes a sharp, large amplitude electrical signal to be generated. When an impact on the upper surface is not directly above the sensor, the initial shock wave detected by the sensor is very much reduced and the electrical signal correctly represents the strength of the oscillations of the block resulting from the impact. For most applications, it is desirable to avoid this discrepancy so that striking the percussion pad anywhere on its surface gives a uniform, predictable sound. It is particularly desirable that instead of the shock wave, a vibration of the whole block that results from an impact should be sensed. It is further desirable that the first such vibration should rapidly be sensed, in order to decrease the reaction time of the pad so that there is no appreciable delay before the electronically generated sound is heard.

One approach to removing the effect of the shock wave has been to mount the sensor on a bracket, the bracket being attached to the lower surface of the block close to one of its edges. This position of the bracket has the effect of moving the most sensitive region of the pad to one edge so that striking the pad near its centre does not produce a sensed shock wave. However, the bracket may also reduce the sensitivity of the pad to the oscillations that it is desired to measure. Moreover, the provision of a bracket increases the complexity and manufacturing cost of the pad and the bracket can be difficult to accommodate within an attractive appearance.

SUMMARY OF THE INVENTION

The invention provides a percussion pad comprising a block resiliently supported on a base, the block including an upper surface that may be struck to activate the block and a lower surface on which is mounted a sensor for detecting when the upper surface is struck, wherein the block encloses a cavity, the cavity being located in the block above the region of the lower surface on which the sensor is mounted.

The shock from an impact on the upper surface cannot be transmitted through the cavity. Because the cavity is located directly above the region of the lower surface where the sensor is mounted, the shock from an impact on the upper surface above the sensor cannot be transmitted directly to the sensor. As previously explained, shock waves from impacts on peripheral areas of the upper surface are not strongly transmitted to the centrally mounted sensor. Thus the initial shock wave is not significantly detected from an impact on any part of the surface and the pad provides more uniform sensitivity over the surface than in the prior art. The sensitivity profile can also be made symmetrical about the centre of the pad.

The lateral extent of the cavity is preferably greater than the lateral extent of the sensor or, if the sensor is mounted on the lower surface of the block via a mounting element, the lateral extent of the cavity is preferably greater than the lateral extent of the mounting element at its junction with the lower surface. In preferred embodiments, the cavity is generally square or disc-shaped. Alternatively, the cavity may extend to one or more edges of the block so as to be in communication with the surrounding atmosphere.

By making the lateral extent of the cavity greater than that of the sensor or its mounting, it can be ensured that there exists no direct path for vibrations to travel vertically from any part of the upper surface to the sensor. Direct mounting of the sensor on the lower surface gives good sensitivity to the desired modes of oscillation of the pad but it is possible to employ a mounting element that uses mechanical amplification to enhance sensitivity further.

In addition to the sensor mounted on the block, there may be one or more proximity switches mounted on the fixed base of the percussion pad for sensing displacement of the block relative to the base, or pressure sensors mounted within the resilient supports.

The block preferably includes an upper layer and a lower layer, wherein the cavity is formed by a blind bore in one of the layers at its junction with the other of the layers. In an alternative embodiment, the cavity may be formed as a channel extending across the width of one of the layers at its junction with the other of the layers. In another alternative, the block may include an upper layer, a lower layer and a middle layer, wherein the cavity is formed by a through hole in the middle layer sandwiched between the upper and lower layers. Suitable materials for these layers of the block include wood, steel and aluminium.

In a further preferred embodiment, the upper surface of the block may be provided by an outer layer of silicone rubber-like material. This emits little acoustic sound when struck with a drumstick but returns energy to the drumstick to produce a "kick-back" giving a similar feel to a drum. Alternatively, the upper surface may be a wooden surface of the upper layer for use, for example, with xylophone hammers.

DESCRIPTION OF THE PREFERRED EMBODIMENTS

Figure 1:
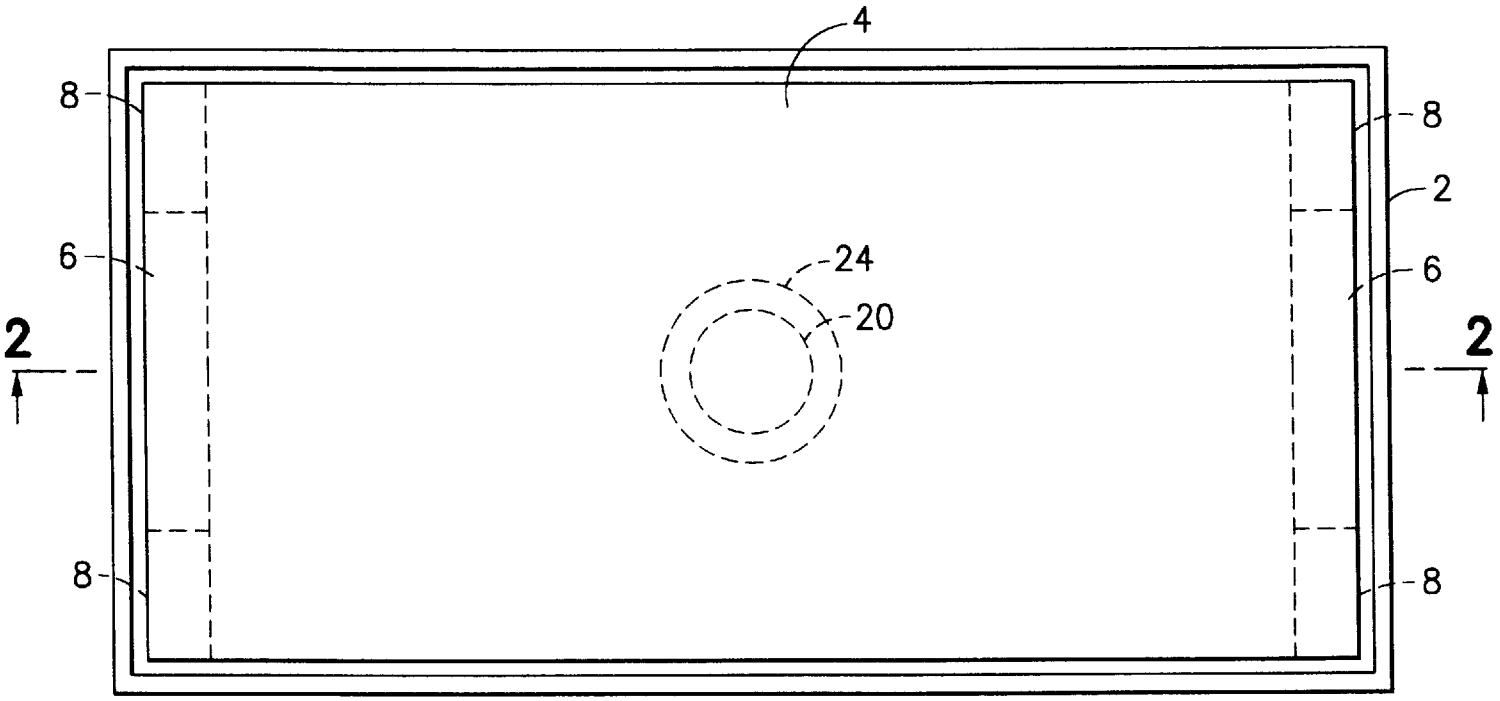
FIG. 1 is a plan view of a percussion pad in accordance with the invention.
Figure 2:
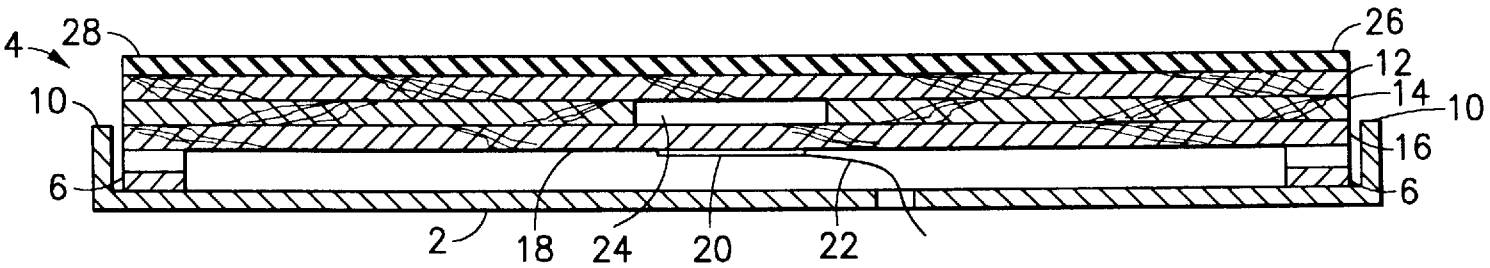
FIG. 2 is a sectional elevation on line A—A of FIG. 1.

The percussion block illustrated in FIGS. 1 and 2 includes a rectangular base 2 which has means (not shown) for fixing it to a stand, for example as part of a drum kit. A rectangular block 4 is resiliently supported on the base 2 by cushion means 6, which allow the pad 4 to vibrate or otherwise move with respect to the base 2. As shown, each of the cushion means 6 consists of a foam strip along a short side of the base 2, the strip having a raised portion 8 at each end. The two raised portions 8 of each of the two cushion means 6 thus provide support for the block 4 at its four corners. Around the outer edges of the base 2 are upstanding walls 10, which hide the cushion means 6 and the underside of the block 4 from view.

The block 4 is of uniform overall thickness and comprises an upper layer 12, a middle layer 14 and a lower layer 16, the middle layer 14 being sandwiched between the upper and lower layers 12,16. At the centre of the lower surface 18 of the lower layer 16 is mounted a sensor 20, such as a piezoelectric sensor, for detecting vibration of the block 4. In response to such vibration, the sensor 20 generates electrical signals, which are transmitted along wires 22 to external circuitry (not shown) for electronic processing and the production of sound.

The upper, middle and lower layers 12,14,16 are of plywood. A cylindrical through hole in the centre of the middle layer 14 defines a disc-shaped cavity 24 between the upper and lower layers 12,16. As best seen in FIG. 1, the cavity 24 is concentric with the circular sensor 20 and has a larger diameter than the sensor 20.

In the illustrated embodiment, an outer layer 26 of rubber is formed on the upper layer 12, to provide an upper surface 28, which may be struck with a drumstick to activate the block. The outer layer 26 may alternatively be omitted so that the upper surface is provided by the wooden upper layer 12.

Figure 4:
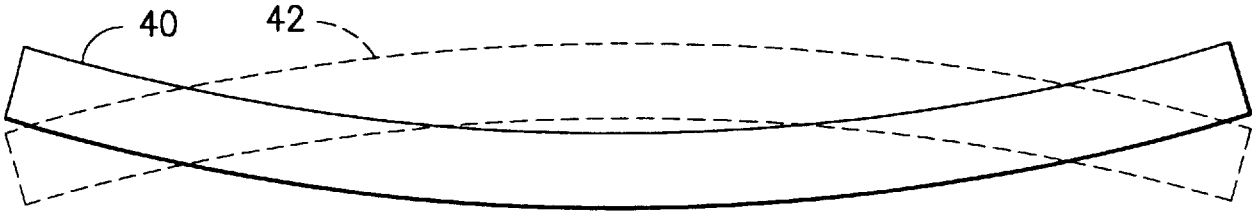
FIG. 4 is a schematic side view of a block in accordance with the invention, illustrating a principal mode of vibration.

When a block according to the described embodiment of the invention is struck with a drumstick, a rigid mode of vibration occurs, in which the whole pad 4 moves up and down as an essentially rigid body. However, the detection system of the present invention makes use of the much higher frequency dynamic modes of vibration, for example that in which the block flexes longitudinally in a single curve as illustrated schematically in FIG. 4. The solid line 40 represents one extreme of the flexing motion and the dashed line 42 represents the opposite extreme. In this mode of vibration, there is no transverse flexing of the block. In the drawing the amplitude of the vibration is greatly exaggerated for enhanced clarity. A typical frequency for this mode of vibration in the illustrated embodiments would be 500 Hz. Other modes of vibration of the block, including transverse flexure and higher harmonics, also contribute to a lesser extent.

Figure 3:
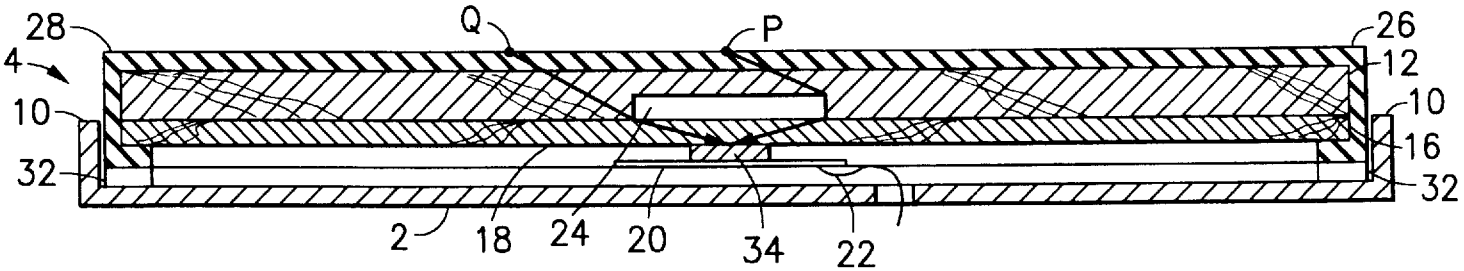
FIG. 3 is a sectional elevation, similar to FIG. 2, illustrating an alternative embodiment of the invention.

FIG. 3 illustrates several mutually independent variations from the embodiment of FIGS. 1 and 2. Corresponding elements are given the same numbers as previously.

In the embodiment of FIG. 3 the block does not include a middle layer 14 between the upper and lower layers 12,16. Instead, the cavity 24 is formed as a blind bore in a lower surface of the upper layer 12 and is closed by the adjoining lower layer 16.

Figure 5:
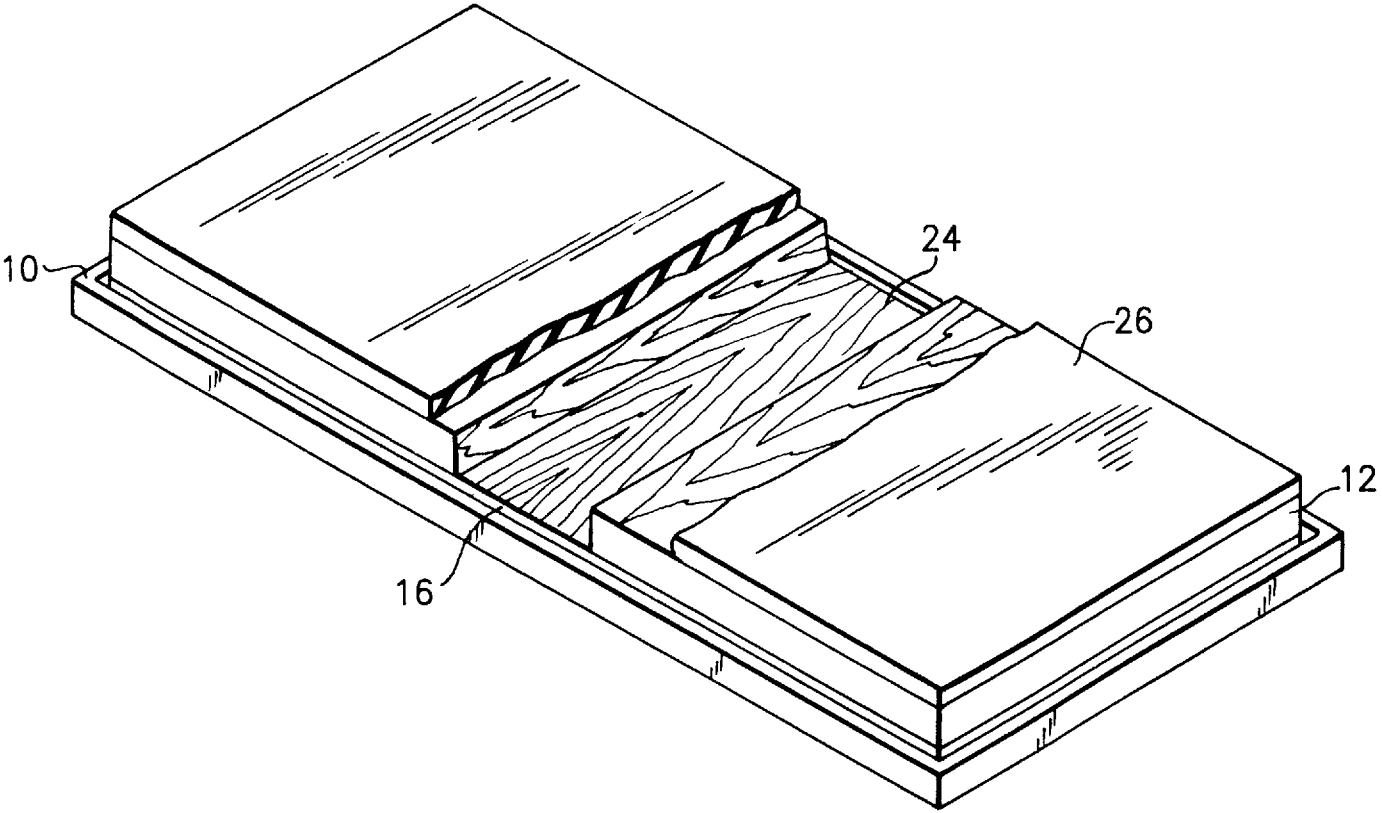
FIG. 5 is a perspective view of the block of the percussion pad of this invention showing a cavity extending through the side walls of the block.

In an alternative embodiment as illustrated in FIG. 5, the cavity may be formed as a channel extending across the full width of the lower surface of the upper layer 12 so that after the lower layer 16 has been affixed thereto the cavity 24 remains in contact with the surrounding atmosphere through openings in side faces of the block.

FIG. 3 also shows that it is possible to mould the rubber outer layer 26 around the sides of the block 4 to overlap the lower surface 18, which enhances the appearance of the block. Feet 32 are moulded integrally with the outer layer 26 at each corner of the underside of the block 4, to provide resilient support for the block 4 on the base 2 in place of the cushion means 6 of FIGS. 1 and 2. The rubber material of the outer layer 26 and its integral feet 32 must be carefully chosen to provide the desired feel and vibration transmitting properties of the outer layer 26 in addition to the cushioning properties of the feet 32.

FIG. 3 further differs from FIG. 2 in that the sensor 20 is mounted on the lower surface 18 of the block 4 via a mounting element 34. This allows the sensor 20 to have a diameter larger than that of the cavity 24, while the mounting element 34 has a diameter smaller than that of the cavity and thereby retains the advantages of the invention.

It may be seen from FIG. 3 that if a block 4 according to the invention is struck on its upper surface 28 at a point P directly above the sensor 20, there is no direct path from the point of impact to the sensor 20. A shock wave will not propagate significantly through the cavity or along the indicated path from point P around the cavity to the sensor 20, nor along the oblique path from point Q. Therefore the sensor 20 detects only the desired modes of oscillation of the block 4 independently of the point of impact on the upper surface.

I claim:

1. A percussion pad comprising:

a base;

a block including an upper surface and a lower surface having a cavity therein;

at least one resilient support element supporting the block on the base while allowing freedom of movement of the block in any direction relative to the base, whereby when the percussion pad is struck the block vibrates as a rigid body on the at least one resilient support element; and a sensor for detecting the vibrations of the block, the sensor being mounted on a mounting area of the lower surface of the block and being located below the lower surface of the block;

wherein the cavity is aligned in the block between the upper surface of the block and the mounting area of the lower surface of the block; the sensor located outside the cavity.

2. A percussion pad according to claim 1, wherein the cavity has a lateral extent that is greater than the lateral extent of the sensor.

3. A percussion pad according to claim 1, further including a mounting element affixed to said mounting area of the lower surface of the block for mounting the sensor on the block; and wherein the cavity has a lateral extent that is greater than the lateral extent of the mounting element at the mounting area of the lower surface of the block.

4. A percussion pad according to claim 1, wherein the cavity extends to at least one opening in a surface of the block.

5. A percussion pad according to claim 1, wherein the cavity is generally disc-shaped.

6. A percussion pad according to claim 5, wherein the block includes an upper layer and a lower layer, each of the upper and lower layers having a junction surface, and wherein the cavity is created by forming a blind bore in the junction surface of the upper layer or the junction surface of the lower layer and subsequently joining the junction surface of the upper layer to the junction surface of the lower layer.

7. A percussion pad according to claim 5, wherein the block includes an upper layer, a lower layer and a middle layer sandwiched between the upper layer and the lower layer; and wherein the cavity is created by a through hole formed in the middle layer between the upper layer and the lower layer.

8. A percussion pad according to claim 1, further including an outer layer of rubber-like material for striking provided on at least the upper surface of the block.

* * * * *